US006886707B2

(12) United States Patent
Giraud

(10) Patent No.: US 6,886,707 B2
(45) Date of Patent: May 3, 2005

(54) LID FOR DISPOSABLE DRINK CUPS HAVING A FLAP WHEREIN THE LID/CUP ASSEMBLY IS LEAK AND DROP RESISTANT

(75) Inventor: Jean Pierre Giraud, Paris (FR)

(73) Assignee: Capitol Cups, Inc., Amsterdam, NY (US)

( * ) Notice: Subject to any disclaimer, the term of this patent is extended or adjusted under 35 U.S.C. 154(b) by 0 days.

(21) Appl. No.: 10/447,072

(22) Filed: May 28, 2003

(65) Prior Publication Data

US 2004/0118847 A1 Jun. 24, 2004

Related U.S. Application Data

(63) Continuation-in-part of application No. 10/326,192, filed on Dec. 20, 2002, now abandoned.

(51) Int. Cl.[7] ..... B65D 51/18

(52) U.S. Cl. ..... 220/254.4; 220/254.1; 220/839; 220/713; 220/716; 220/717; 220/718

(58) Field of Search ..... 220/254.1, 254.3, 220/254.7, 375, 703, 713, 711, 716–718, 831–834, 839, 360, 367.1; 215/387; 229/404

(56) References Cited

U.S. PATENT DOCUMENTS 2,130,676 A * 9/1938 Sebell ..... 222/484
3,990,615 A * 11/1976 Kerwin et al. ..... 222/541.9
4,589,569 A * 5/1986 Clements ..... 220/380
5,257,709 A * 11/1993 Okabe et al. ..... 220/62.22
5,377,861 A * 1/1995 Landis ..... 220/380
6,089,397 A * 7/2000 Van Melle ..... 220/270
6,644,490 B2 * 11/2003 Clarke ..... 220/254.1
6,679,397 B2 * 1/2004 Smith et al. ..... 220/254.1
2003/0089714 A1 * 5/2003 Dart et al.

FOREIGN PATENT DOCUMENTS

FR 2736620 * 1/1997

* cited by examiner

*Primary Examiner*—Robin A. Hylton
(74) *Attorney, Agent, or Firm*—Greenberg Traurig LLP

(57) ABSTRACT

The disclosure describes a one-piece lid for a cup, the lid comprising: a top wall having a generally circular periphery; an annular side wall depending from the top wall about its periphery; an annular mounting portion at a bottom of a side wall for sealingly engaging the lip of the drinking cup; the lid having a drinking opening therein adjacent the periphery to enable drinking from the cup without removal of the lid; the top wall including a recessed portion adjacent to the drinking opening for receiving the upper lip of a person drinking from the cup; at least one vent opening, which is separate from the drink opening, is positioned on the top wall; a flap integrally hinged to the lid, the flap, when in a covering position, has dimensions that permit the flap to cover the drinking opening and vent opening, the flap having an underside provided with a button, which is positioned to be received within the drinking opening, and at least one plug, which is positioned to be received within the vent opening, and when the button is received in the drinking opening, the flap is maintained in the covering position.

9 Claims, 6 Drawing Sheets

LID FOR DISPOSABLE DRINK CUPS HAVING A FLAP WHEREIN THE LID/CUP ASSEMBLY IS LEAK AND DROP RESISTANT

RELATED APPLICATION

The present application is a continuation-in-part of U.S. Ser. No. 10/326,192, filed Dec. 20, 2002 now abandoned.

FIELD OF THE INVENTION

The present invention relates generally to a leak resistant lid for use in combination with a drinking cup and more particularly to a lid through which beverage can be consumed. In an example, the lid is provided with a flap that seals the opening.

BACKGROUND OF THE INVENTION

Lids for disposable beverage cups, such as disposable coffee cups, are known in the art. Many beverages are consumed in transit, such as between the home and the workplace. Thus, the need to provide a lid that permits the beverage to be consumed while reducing, if not minimizing, spillage of the beverage. Furtherance of the latter interest is challenging, since, as noted above, the beverage is consumed while the consumer is in motion, such as, for example, in a car, while walking, exercising, or riding public transportation.

SUMMARY OF THE INVENTION

In accordance with the present invention, a leak resistant lid for a disposable beverage cup is provided which allows the consumer to drink through the lid while substantially reducing spillage of the beverage. In one embodiment, the lid includes a mounting portion for gripping the upper rim of the cup, a side wall extending upwardly from the mounting portion, a top wall, and an opening through which beverage is consumed. With this arrangement (including provision of at least one vent hole in the lid), the lid is substantially closed (except for the drinking opening) that at least reduces the undesired consequences of splashes and spills.

In yet another embodiment, a recess is provided adjacent the drinking opening, through which beverage is consumed. The recess accommodates the upper lip of the consumer. The lid is further provided with a flap that is integrally hinged to the lid and that moves into a covering position in which the flap covers the opening providing a leak resistant beverage cup. In one specific embodiment, the flap is provided with a button that is received in the opening, and becomes frictionally engaged therewith, in order to maintain the flap in the covering position. In another specific embodiment, a vent opening may be formed in the lid to enable airflow into the cup to facilitate the flow of liquid through the drinking opening. In another embodiment, the vent opening is formed in the recess, and a plug provided on the flap seals the vent opening when the flap is in the covering position.

In one embodiment of the present invention, the lid is provided with vent holes that are positioned off of a line that, if drawn would pass through the drinking opening and through the diameter of the lid. For example, the underside of the flap is provided with a pair of pegs that are sized and positioned to be received within the vent holes. When the lid is closed and the pegs are received within the vent holes, the lid is maintained in a locked, closed state.

In yet another embodiment, the topside of the flap is provided with at least one peg, and the cut out portion of the lid is provided with an opening that is sized and positioned to receive the peg positioned on the topside of the flap. The lid can be locked in the open position when the peg positioned on the topside of the flap is received in the opening in the vent hole.

Though the figures of the embodiments show the flap extending over the edge, it should be readily apparent to a person of skill in the art that the flap can be shortened order so that the distal end of the flap will not extend beyond the edge of the lid.

DETAILED DESCRIPTION OF THE EMBODIMENTS

Figure 1:
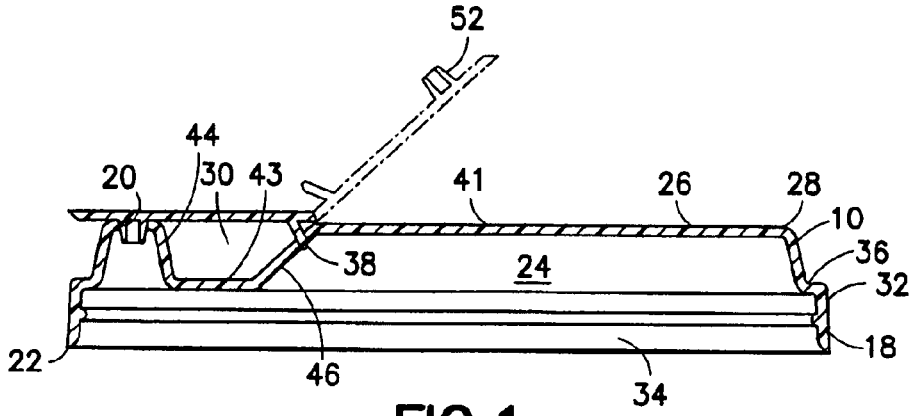
FIG. 1 is a side elevational view of a lid of the present invention.

The present invention is generally embodied in a lid 10 for a drinking cup that is leak resistant. The lid 10 may be used with cups of various types, and is particularly suitable for use with disposable cups of the type commonly used as carry-out containers for beverages such as coffee and the like. Such cups are commonly made of materials that include, but are not limited to, styrofoam, paper, or plastic.

The lid 10 mounts to a cup (not shown) and forms an engagement with the cup. In one embodiment, the lid is secured in place on the cup by an annular ring 18, which engages the rim or lip of the cup (not shown). An opening 20 is provided to enable drinking from the cup 12 without removal of the lid 10.

The lid 10 includes an annular side wall 24 extending up from the mounting portion 18 and a top wall 26 extending across the top of the lid 10 and having a generally circular periphery 28 adjoining the side wall 24, and the drinking opening 20 is adjacent the periphery 28 of the top wall 26. In the illustrated embodiment, the opening 20 is formed through the top wall 26. In accordance with another embodiment (not shown), the opening might be formed in the sidewall 24 just below the periphery 28 of the top wall 26. The drinking opening 20 is positioned so that a person may drink from the opening 20 without contacting the bottom edge 22 of the lid 10 with the person's lower lip.

A recess 30 is formed in the top wall 26 adjacent the drinking opening 20 to accommodate the upper lip of the user. This enables one drinking from the cup to essentially position the opening in the lid in the center of the mouth to reduce, if not eliminate, spillage while drinking.

In one embodiment relating to the lid engaging the cup, the mounting portion 18 includes a resilient annular gripping portion 32 configured to grip the bead on the lip of the cup 12. This arrangement forms a seal between the gripping portion 32 and the bead of the lip of the cup. Also, the mounting portion 18 includes an outwardly flared skirt 34 depending from the gripping portion 32, which facilitates mounting of the lid on the cup. As the lid 10 is pushed downward onto the lip of the cup, the skirt 34 aids in centering the lid and in deflecting the gripping portion 32 to an open position, enabling it to fit over the bead. In one embodiment, an annular channel 36 is defined at the juncture of the gripping portion 32 and the bottom of the sidewall 24, which enables a small amount of liquid to be retained should such liquid drip down the sidewall 24.

In yet another embodiment, to enable the opening 20 to be spaced from the lower edge 22 of the lid 10 by a distance sufficient to enable one to drink through the opening 20 without contacting the lower edge 22 of the lid 10 with his lower lip 23, the side wall 24 extends upwardly from the mounting portion 18 for a preselected distance. In one embodiment, the sidewall 24 is frusto-conical in shape, sloping upward and radially inward from the mounting portion to the top wall 26.

In another embodiment, a vent hole 38 is formed in the inclined surface 46, which extends between the bottom surface 43 of the recess 30 and the top wall 26. The flat portion 41 of top wall 26 is can be manufactured to be sufficiently durable. The inner diameter of the rim 40 may be slightly larger than the bottom diameter of the cup 12, and the flat portion covers more than half of the area enclosed by the rim 40. A retaining wall 42 may also be provided. The retaining wall 42 may retain liquid, which may seep onto the flat portion 41 through the vent hole 38 to prevent such liquid from dripping down the sidewall 24.

In a further embodiment, the flat portion 41 has a generally D-shaped periphery including an arcuate portion defined by the retaining wall 42 and a linear portion defined by the recess 30. In one example, the arcuate portion preferably defines an arc of greater than about 180° so that the flat portion 41 may stably support a cup 12 having a bottom diameter slightly smaller than the inner diameter of the rim 40.

The drinking opening 20 is formed in the rim 40. To reduce, if not eliminate, accidental splashing or spilling of liquid through the drinking opening 20, the drinking opening is relatively small.

In one example, the recess is formed adjacent the drinking opening 20 and radially inward thereof. In addition to accommodating the upper lip 28 of one drinking from the cup, the recess 30 may also inhibit splashing of the liquid up through the drinking opening 20.

Recess 30 is defined by wall 44, which extends downward from the rim 40. In an alternative arrangement, the wall extends radially inward from the rim 40 as well. The recess 30 may have a depth slightly less than the height of the sidewall 24. This enables the lid 10 to be placed on a full cup without the lowermost portion of the top wall 26 extending into the liquid in the cup.

The configuration of the recess 30 enables it to accommodate the upper lip of one drinking from the cup without presenting unacceptable difficulties in molding the lid. The slope of the first inclined surface 46 is such that its underside (i.e., the beverage facing side) does not tend to collect liquid when the cup is tilted. Another advantage of the configuration of the recess 30 described above is that it does not interfere with stacking of the lids 10 in nested relation.

The lid is further provided with a hinged flap 50 adapted to be received within the drinking opening 20, and to form an interference fit therewith when inserted into the opening to form a leak resistant seal. The flap 50 is attached to the lid 10 on the top wall 26 of the lid by hinge 60, in the vicinity of the junction of the top wall 26 and the inclined surface 46. The flap is sufficiently long and sufficiently wide so as to extend from the location of the hinge to cover the opening 20 located on the rim 40. In one embodiment, button 52 is located on the underside of the flap, and as indicated above, has a size and shape that permits it to mate with the opening 20 in the rim. Also, the button 52 is sufficiently sized and shaped so that the button, when inserted into the opening, forms an interference fit therewith, in order to maintain the flap over the opening.

In yet another embodiment, the vent hole 38 is provided in the recessed portion. When a vent hole is included in the lid then a plug or comparable device 56 is provided on the underside of the flap, so that when the lid is in the covering position, the plug 56 plugs the vent opening and thus, forms a leak resistant seal.

The hinge between the flap and the cup can be formed in the molding step.

In one embodiment, the lid 10 is of a one-piece plastic construction. The lid may be manufactured by a thermoforming operation, such as by vacuum forming. After the vacuum forming operation has been completed, the various openings may be formed in the lid. In one embodiment, the drinking opening 20 is formed with a punch and die. In another embodiment, the vent opening 38, which are preferably smaller than the drinking opening 20, may be formed simply by puncturing the top wall 26 of the lid 10 with a pointed tool.

The thickness of the material of the lid 10 is selected to provide satisfactory strength while enabling enough flexibility to facilitate gripping engagement of the lip of the cup by the gripping portion of the lid. Also, as noted above, the lid requires a relatively small amount of material, which enables it to be produced economically.

The lid 10 described herein is particularly well suited for use where beverages are sold for take out. A person can fill a cup 12 with a beverage such as coffee and fix the lid 10 over the container by snapping it onto the cup 12. The consumer may then pick up the cup 12 with one hand and drink from it while walking or riding in a vehicle without removing or penetrating the lid 10. For added protection against spillage, the opening can be sealed by placing the flap over the opening, with the button placed inside the opening to form a leak resistant seal.

Figure 5:
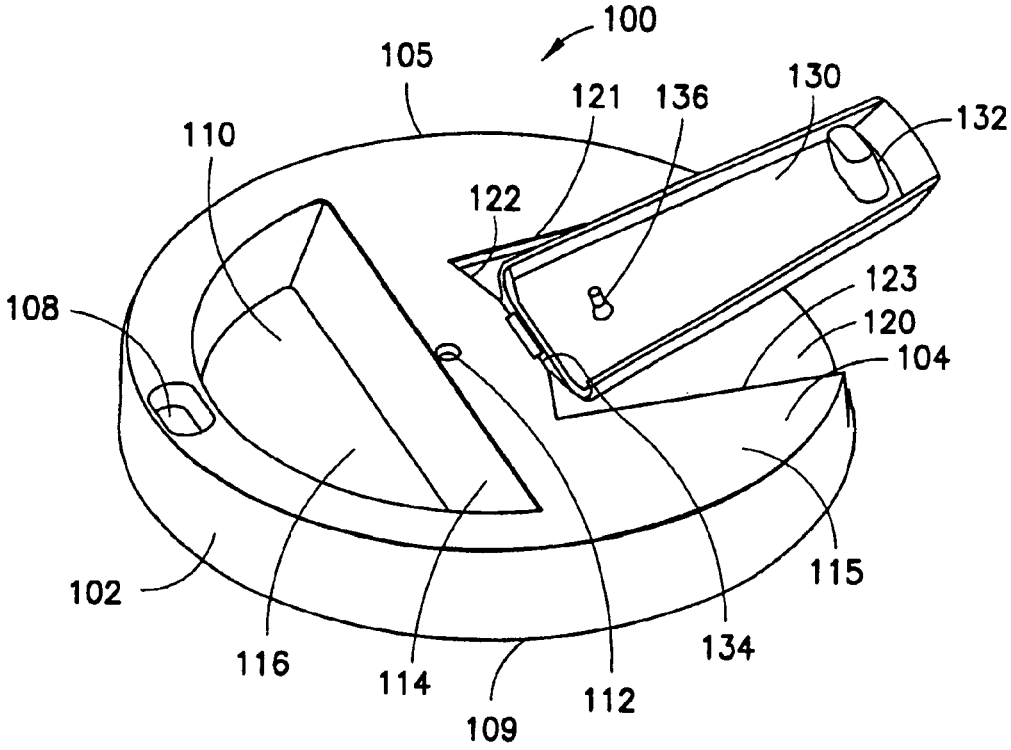
FIG. 5 is a perspective view of yet another embodiment of the present invention, with the lid in an open position.
Figure 6:
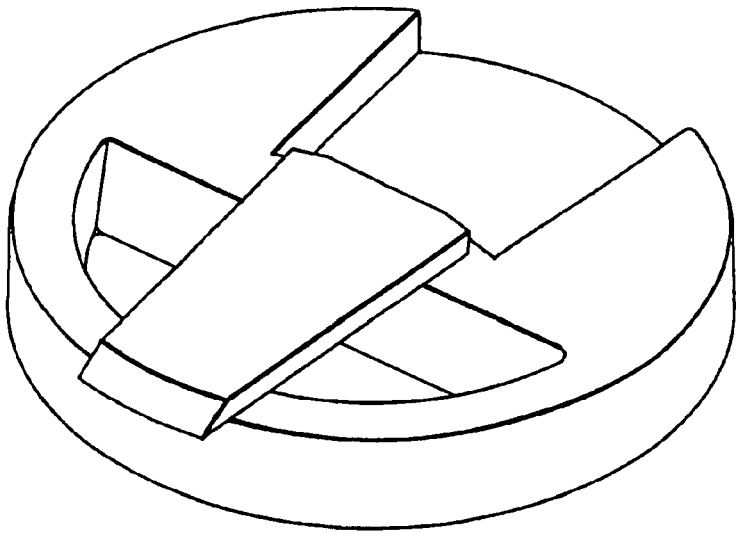
FIG. 6 is a perspective view of the embodiment shown in FIG. 5, with the lid in an closed position.
Figure 7:
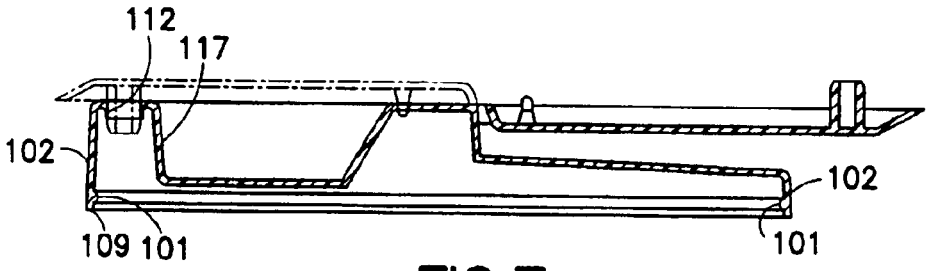
FIG. 7 is a cross sectional view of the embodiment shown in FIG. 5.

Yet another embodiment of the present invention is shown in FIGS. 5–7 of the present disclosure. Lid 100 may be used with cups of various types, and is particularly suitable for use with disposable cups of the type commonly used as carry-out containers for beverages such as coffee and the like. Such cups are commonly made of materials that include, but are not limited to, Styrofoam, paper, or plastic.

In one example, best seen in FIG. 7, the lid 100 is mounted to a cup by means of a lip 101 provided on the bottom of annular sidewall 102, which engages the rim or lip of the cup. Lip 101 forms a seal between the annular sidewall 102 and the bead of the lip of the cup.

The lid 100 includes an annular sidewall 102, which depends downward from the top wall 104. The top wall 104 has a generally circular periphery 105 where the sidewall 102 joins the top wall 104. Drinking opening 108 is adjacent the periphery 105 of the top wall 104. In the illustrated embodiment, the opening 108 is formed through the top wall 104. In accordance with another embodiment (not shown), the opening might be formed in the sidewall 102 just below the periphery 105 of the top wall 104. The drinking opening 108 is positioned so that a person may drink from the opening 108 without contacting the bottom edge 109 of the lid 100 with the person's lower lip.

A recess 110 is formed in the top wall 104 adjacent the drinking opening 108 to accommodate the upper lip of the user. This enables a person drinking from the cup to essentially position the opening in the lid in the center of the mouth to reduce, if not eliminate, spillage while drinking.

In one embodiment, to enable the opening 108 to be spaced from the lower edge 109 of the lid 100 by a distance sufficient to enable one to drink through the opening 108 without contacting the lower edge 109 of the lid 100 with his or her lower lip, the side wall 102 extends upwardly from the lower edge 109 for a preselected distance.

In another embodiment, a vent hole 112 is formed in the top wall 104, in the vicinity of the inclined surface 114 extending between the bottom surface 116 of the recess 110 and the top wall 104. The flat portion 115 of top wall 104 is can be manufactured to be sufficiently durable in order to support a cup, so that a plurality of cups having lids 10 thereon may be stacked on top of one another.

In a further embodiment, the flat portion 115 of top wall 104 includes a cut out portion 120. The cut out portion is provided with sidewalls 121, 122, 123 on the periphery of the cut out portion 120.

In the illustrated embodiment, the drinking opening 20 is formed on the top surface, between the recess 110 and the location where the sidewall 102 joins the top wall 104. The recess accommodates the upper lip of one drinking from the cup, and may also inhibit splashing of the liquid up through the drinking opening 20.

To reduce, if not eliminate, accidental splashing or spilling of liquid through the drinking opening 108, the drinking opening 108 is relatively small.

In the illustrated embodiment, the recess 110 is defined by wall 117, which extends downward from the top wall 104. In an alternative arrangement, the wall extends radially inward from the top wall 104 as well. The recess 110 may have a depth slightly less than the height of the sidewall 102. This enables the lid 100 to be placed on a full cup without the lowermost portion of the top wall extending into the liquid in the cup.

The lid is further provided with an integrally attached hinged flap 130 provided with a button or other similarly shaped object 132 adapted to be received within the drinking opening 108, and to form an interference fit therewith when inserted into the opening that results in a leak resistant seal. The flap 130 is integrally attached to the lid 100 on the top wall 104 of the lid by hinge 134, at the vicinity of the junction of the top wall 104 and cut out portion 120, in the vicinity of the midpoint of the lid. In one embodiment, the hinge is a "living hinge"—for purposes of the present invention, the term "living hinge" means that that the lid can be pivoted back and forth for at least 20 times without breaking the hinge. The flap is sufficiently long and sufficiently wide so as to extend from the location of the hinge to cover the opening 108. The button 132 is located on the lid-facing side of the flap, and as indicated above, has a size and shape that permits it to mate with the opening 108. Also, the button 132 is sufficiently sized and shaped so that the button, when inserted into the opening 108, forms an interference fit therewith, in order to maintain the flap over the opening.

In yet another embodiment, vent hole 112 is provided. In one illustrated embodiment, the vent hole is position on the top wall 104, in the vicinity of the recessed portion 110. A plug 136 is provided on the lid-facing side of the lid, so that when the lid is in the covering position, the plug 56 plugs the vent opening to form a leak resistant seal.

Figure 8:
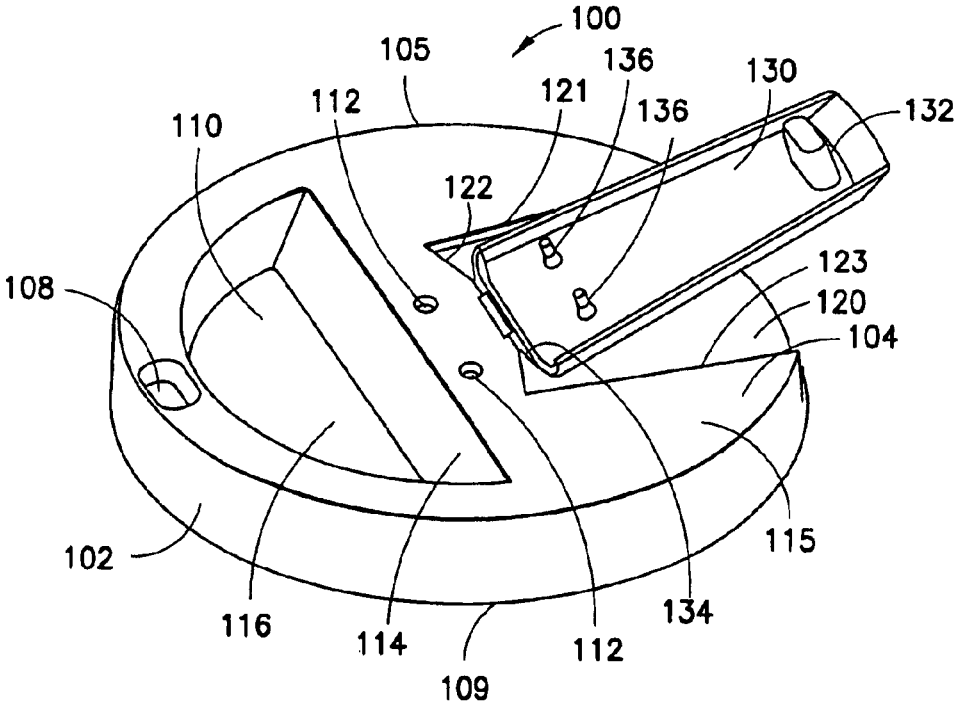
FIG. 8 is a view of another embodiment of the present invention.

In one embodiment of the present invention, shown in FIG. 8, the lid is provided with a pair of vent holes 112 that are positioned off of a line that, if drawn, would pass through the diameter of the lid and the drinking opening. The underside 130A of the flap 130 is provided with a pair of pegs 136 that are sized and positioned to be received within the vent holes 112. When the flap is closed and the pegs are received within the vent holes, the flap is maintained in a locked, closed state.

Figure 9:
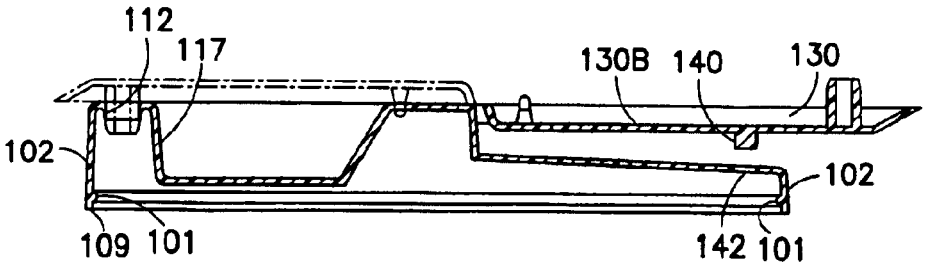
FIG. 9 is a view of yet another embodiment of the present invention.

In yet another embodiment, shown in FIG. 9, the topside 130B of the flap 130 is provided with at least one peg 140, and the cut out portion 120 of the lid is provided with an opening 142 that is sized and positioned to receive the peg 140 positioned on the topside of the flap 130. The flap 130 can be locked in the open position when the peg that is positioned on the topside of the flap is received in an opening 142 in the vent hole.

Figure 10:
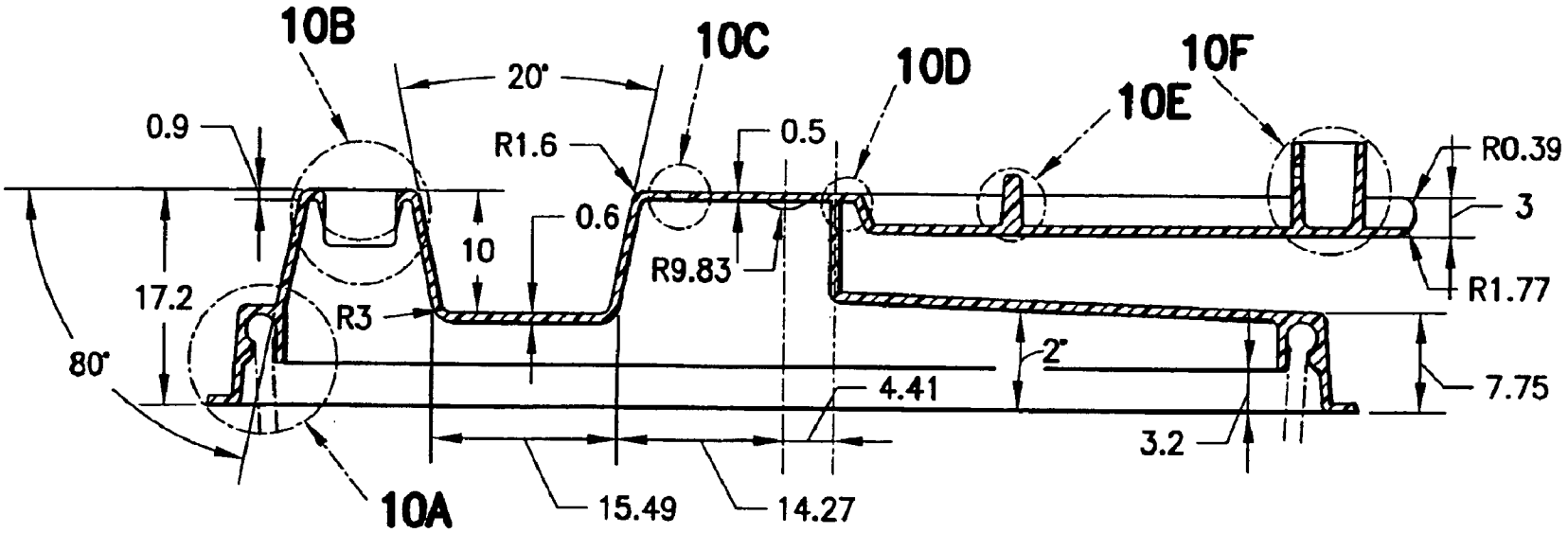
FIG. 10 is a cross sectional view of another embodiment of the present invention.
Figure 10A:
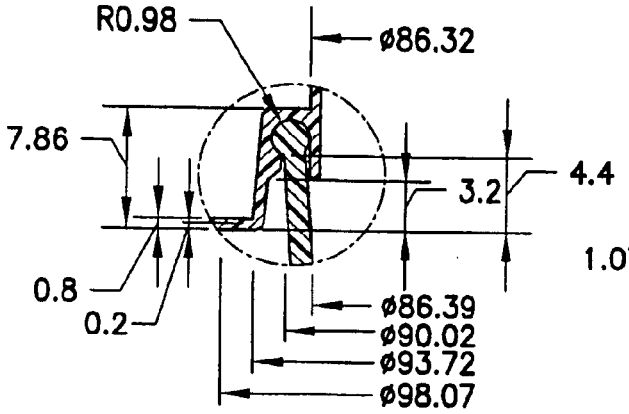
FIGS. 10A through 10F are enlarged views of various sections shown in FIG. 10.
Figure 10B:
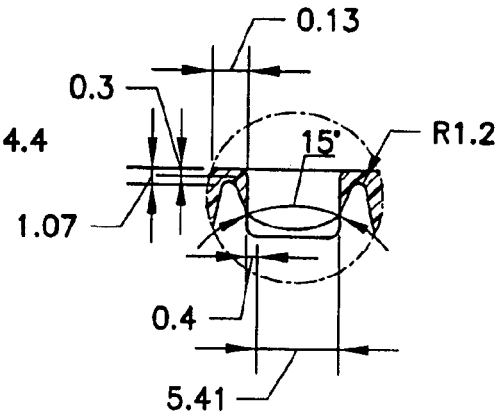
Figure 10C:
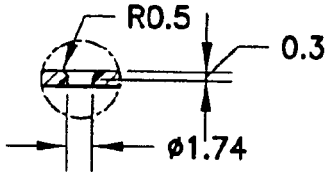
Figure 10D:
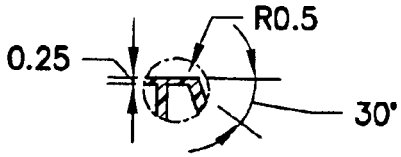
Figure 10E:
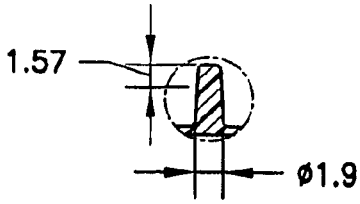
Figure 10F:
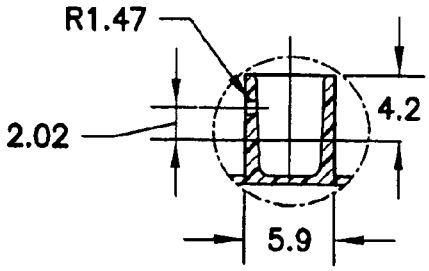

In a further embodiment, shown in FIG. 10 and the enlarged views shown in FIGS. 10A through 10F, specific dimensions are provided for the various sealing areas between the flap and the lid as well as between the lid and the container. It is understood that these dimensions are merely illustrative and are not meant to limit the sealing method to the dimensions shown in these Figures.

For purposes of the present invention, when the lid engages the container and the integrally attached hinged flap engages the opening of the lid (and if a vent hole is included, a means provided on the flap engages the vent hole), the container/lid assembly of the present invention is leak resistant. For purposes of the present invention, the phrase "leak resistant" means if the amount of fluid that leaks from the container/lid assembly is less than 1 ounce after the lid flap has been opened and re-closed and the container/lid assembly tested per Section C., Step 4 of the following "Leak Resistant" test method.

LEAK RESISTANT TEST METHOD

A: Preparation of Test Materials

1. Collect coffee cup lid samples and cups.
2. Ensure that there is a representative sample.
3. Prepare 10 samples of each container/lid assembly for testing.
4. Prepare coffee in standard coffee pot.

B: Test Protocol

1. First test of cup/lid assembly should be conducted before the flap of the lid has ever been opened.
2. Fill each cup to market value. Measure exact amount of fluid in cup. Refill cups for testing. Fully engage the lid with the cup and fully engage the flap with the lip.

C: Procedure:

1. Lay container/lid assembly on its side with the lid opening facing the surface.
2. Measure the amount of fluid in the cup after 1 minute of cup lying on its side with lid opening facing the surface. Record amount of liquid remaining in cup on testing worksheet.
3. Refill cup and continue to test cup on its side for 5 minutes. Measure the amount of fluid that in the cup after 5 minutes.
4. Open flap of lid and re-close for each lid being tested.

D: Determine Leak Resistant

Container/lid assembly are considered "leak resistant" if the amount of fluid that leaks from the container/lid assembly is less than 1 ounce after the flap of the lid has been opened and re-closed and the container/lid assembly tested per Section C., Step 3.

DROP TEST METHOD

A: Preparation

Use the same preparation and test protocol as described above in "A" and "B" of the "Leak Resistant Test Method" but also open flap of lid and re-close for each lid being tested.

B: Procedure

1. Place cups on the edge of a flat surface such that the cup can be knocked over to the right when facing the cup and the cup fall about 1 feet onto a carpeted surface.
2. Knock cup off the surface onto the carpet.
3. Record if lid comes off or flap opens.

C: Determine Drop Resistance

Container/lid assembly are considered "drop resistant" if the lid does not come off the cup and the flap does not open-up.

Figure 2:
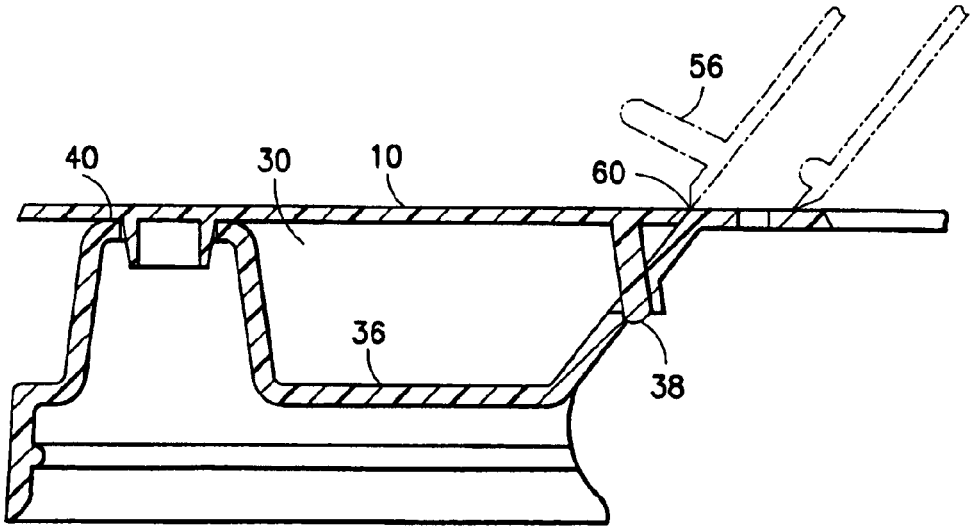
FIG. 2 is a cross sectional view of the lid of FIG. 1.
Figure 3:
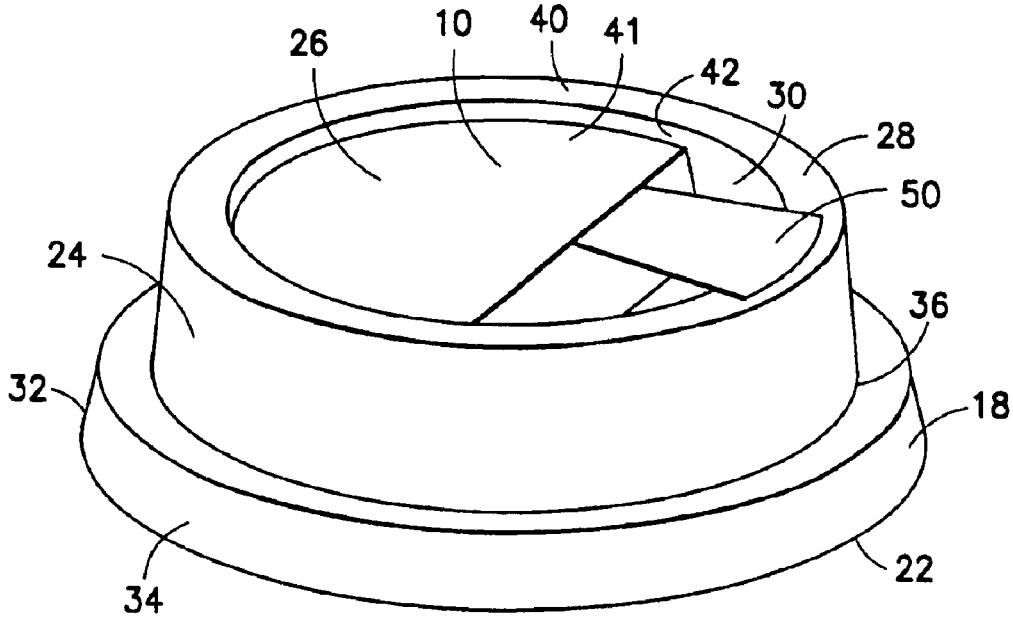
FIG. 3 is a perspective view of the lid of the present invention in the closed position.
Figure 4:
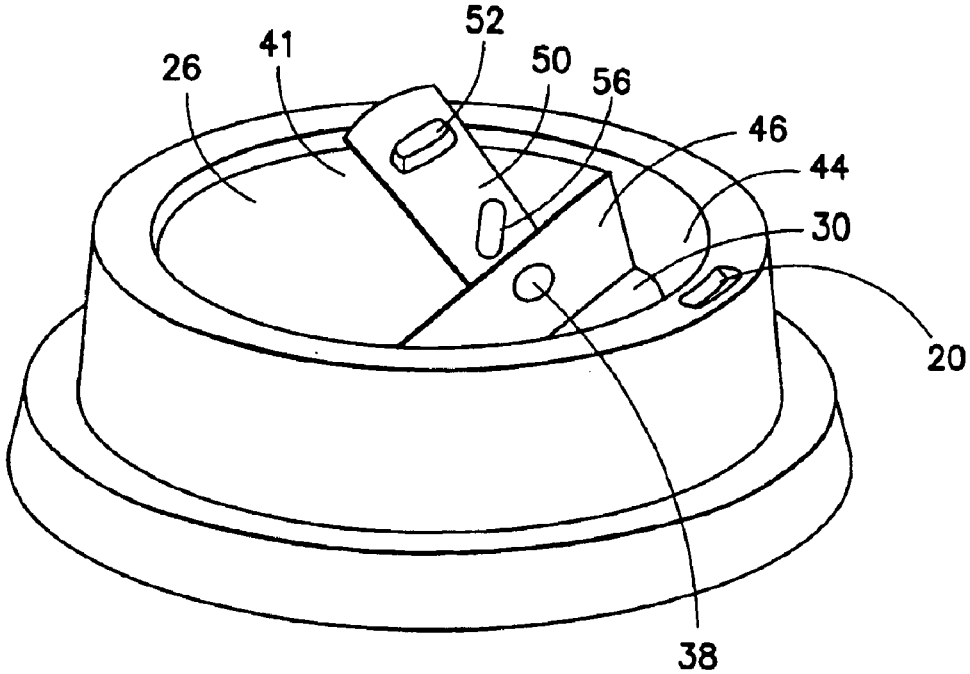
FIG. 4 is a perspective view of the lid of the present invention in the open position.

In one embodiment, the lid of the present invention can be formed in a one shot molding operation. For example, the lid injection molded in a split mold with the flap in the open position (e.g. in the position shown in FIG. 2). Subsequently, the mold separates to allow the flap to remain in the open position and then completely ejecting the lid from the mold.

Though the figures of the embodiments show the flap extending over the edge, it should be readily apparent to a person of skill in the art that the flap can be shortened order so that the distal end of the flap will not extend beyond the edge of the lid.

While embodiments has been described and depicted in the drawings, the claimed subject matter is intended to receive the broadest scope permissible under the law, without being limited to any particular embodiment.

What is claimed is:

1. A one-piece lid for a cup, the lid comprising:

a top wall having a generally circular periphery;

an annular side wall depending from the top wall about its periphery;

an annular mounting portion at a bottom of the side wall for sealingly engaging the lip of the drinking cup;

the lid having a drinking opening therein adjacent the periphery to enable drinking from the cup without removal of the lid;

the top wall including a recessed portion adjacent to the drinking opening for receiving the upper lip of a person drinking from the cup;

at least one vent opening, which is separate from the drink opening, is positioned on the top wall;

a flap integrally hinged to the lid, the flap, when in a covering position, has dimensions that permit the flap to cover the drinking opening and vent opening, the flap having an underside provided with a button, which is positioned to be received within the drinking opening, and at least one plug, which is positioned to be received within the vent opening, and when the button is received in the drinking opening, the flap is maintained in the covering position.

2. The lid of claim 1 wherein the flap is hingedly engaged to the top wall in the vicinity of the junction between the top wall and the recessed portion.

3. The lid of claim 1 wherein the vent opening is positioned in the recessed portion of the lid.

4. The lid of claim 1 wherein the resulting lid/cup assembly is leak resistant in accordance with a leak resistant test and drop resistant in accordance with a drop test.

5. The lid of claim 1 wherein the flap is hingedly engaged to a central portion of the lid.

6. The lid of claim 1 wherein the top wall includes a cut out portion positioned opposite the drinking opening.

7. The lid of claim 1 wherein the vent opening in the top wall pair of vent openings positioned off of a line extending through the drinking opening and the diameter of the lid.

8. The lid of claim 7 wherein the flap has an underside provided with a pair of pegs positioned to be received by the pair of vent openings in the top wall.

9. The lid of claim 6 wherein the flap is sized and positioned to be received in the cut out portion.

* * * * *